United States Patent [19]

Chunshan

[11] Patent Number: 4,593,751

[45] Date of Patent: Jun. 10, 1986

[54] CHEQUER-BRICK FOR VERTICAL COWPERS AND COWPER CHEQUERWORK CONSTRUCTED FROM THESE CHEQUER-BRICKS

[75] Inventor: Pan Chunshan, Shijingshan, China

[73] Assignees: China Metallurgical Imp. & Exp. Corp., China; Paul Wurth S.A., Luxembourg

[21] Appl. No.: 657,027

[22] Filed: Oct. 2, 1984

[30] Foreign Application Priority Data

Oct. 5, 1983 [LU] Luxembourg ..... 85028

[51] Int. Cl.[4] ..... F28D 17/02

[52] U.S. Cl. ..... 165/9.1; 165/9.4

[58] Field of Search ..... 165/9.1, 9.2, 9.4

[56] References Cited

U.S. PATENT DOCUMENTS

| | | | |
|---|---|---|---|
| 1,792,663 | 2/1931 | Strack | 165/9.1 |
| 1,880,011 | 9/1932 | Boynton | 165/9.1 |
| 2,577,170 | 12/1951 | Walters | 165/9.1 |

FOREIGN PATENT DOCUMENTS

| | | | |
|---|---|---|---|
| 126789 | 9/1980 | Japan | 165/9.1 |

*Primary Examiner*—Albert W. Davis, Jr.

*Attorney, Agent, or Firm*—Fishman & Dionne

[57] ABSTRACT

A chequer brick of cruciform shape is provided for the chequerwork of vertical cowpers along with methods of stacking the cruciform shaped chequer brick. The chequer bricks each comprise two cross beams or cross-members of the same length, but having different widths, each cross-member having four conduits arranged at the four points of the cross along with an additional centrally located conduit. The chequer bricks are laid one on top of the other such that the recesses and the intersections between the cross beams form vertical passageways. The particular cruciform shape of the filler bricks of the present invention provides the generation of high tubulance in the passageways passing through the chequerwork while at the same time increasing the heating surface of the chequerwork.

33 Claims, 14 Drawing Figures

FIG. 6a
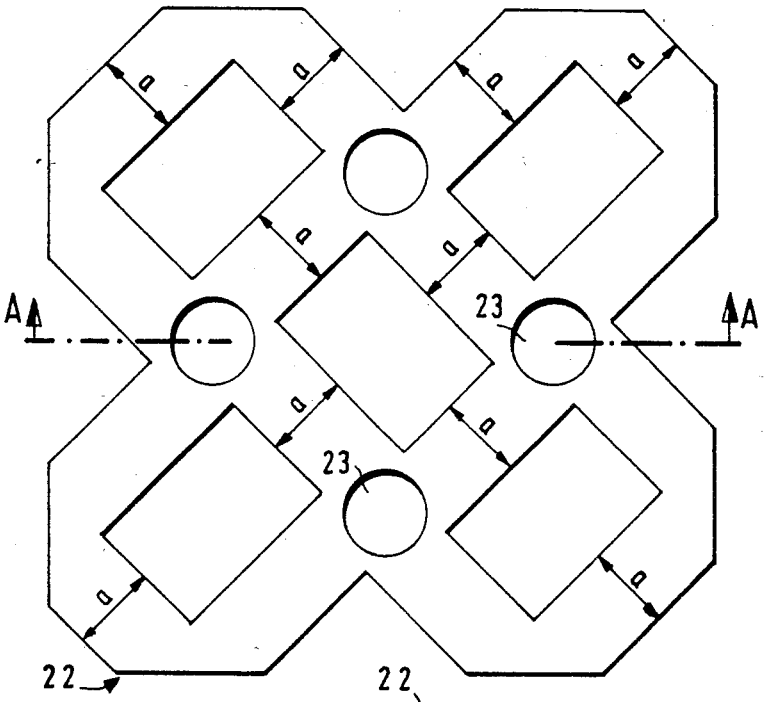
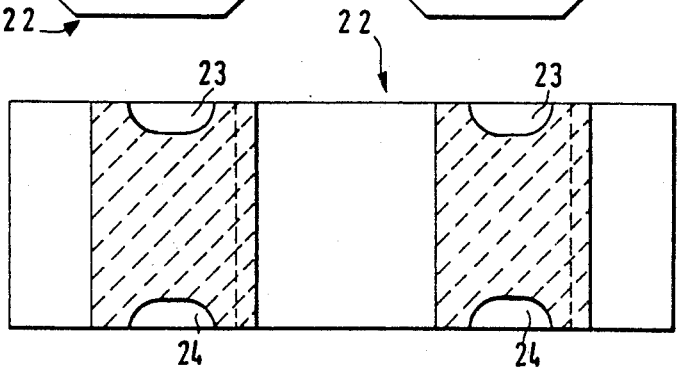
FIG. 6b

CHEQUER-BRICK FOR VERTICAL COWPERS AND COWPER CHEQUERWORK CONSTRUCTED FROM THESE CHEQUER-BRICKS

BACKGROUND OF THE INVENTION

This invention relates generally to a chequerwork for a vertical cowper, the cowper comprising an upright chamber having a filler brick zone therein through which flows combustion heating gas for heating the filler brick or the blast to be heated by the filling. This invention also relates to a novel chequer brick for the chequerwork of the vertical cowper of the type hereinabove described.

As the temperature in which hot blast is blown into a blast furnace rises, and as the hot blast throughput in a blast furnace increases, the physical demands made on the cowper and on its chequerwork similarly increases. It is well known to those in the art that the chequerwork must provide, as effectively as possible, heat exchange between the very hot combustion gases in the filler brick, as well as between the cold blast in the filler bricks, with a minimum loss of pressure.

As a consequence, fluid mechanics and heat technology processes in the cowper are of extreme importance, particularly in the filler brick zone. Thus, the intimate connection between these processes and the entire heat exchange process is well known to those in the art.

It is also well known that the "filling" of a vertical cowper consists of individual filler bricks, conventionally tubular bricks, which are superimposed upon one another to form a pile. This pile is generally as uniform as possible and usually has conduits or passageways which are passing therethrough. Important factors in designing such a piling include good utilization of space, retaining (as much as possible) the conventional construction of a hot blast stove for blast furnaces, achieving maximum possible effective heating surfaces, providing uniform distribution of flow over the cross section of the filler brick zone, as well as providing storage capacity and mechanical (static) stability of the individual filler bricks.

It will thus be appreciated to those skilled in the art that there is a need to increase the efficiency of a vertical cowper by improving the chequerwork in the filler brick zone of the cowper in accordance with the various demands and considerations discussed hereinabove.

SUMMARY OF THE INVENTION

The above discussed and other problems of the prior art are overcome or alleviated by the cowper chequerwork of the present invention. In accordance with the present invention, a novel chequer brick of cruciform shape is provided for the chequerwork of vertical cowpers along with novel methods of stacking the cruciform shaped chequer brick. The chequer bricks each comprise two cross beams or cross-members of the same length, but having different widths, each cross-member having four conduits arranged at the four points of the cross along with an additional centrally located conduit. The bricks are laid one on top of the other such that the conduits and the intersections between the cross beams form vertical passageways. The particular cruciform shape of the filler bricks of the present invention provides the generation of high turbulence in the passageways passing through the chequerwork while at the same time increasing the heating surface of the chequerwork.

The above discussed and other advantages of the present invention will be apparent to and understood by those skilled in the art by the following detailed description and drawings.

BRIEF DESCRIPTION OF THE DRAWINGS

Referring now to the drawings, wherein like elements are numbered alike in the several figures:

FIG. 6*a* is a plan view of another embodiment of chequer brick in accordance with the present invention;

FIG. 6*b* is a cross sectional elevation view along the line A—A of FIG. 6*a;*

DESCRIPTION OF THE PREFERRED EMBODIMENT

Figure 1:
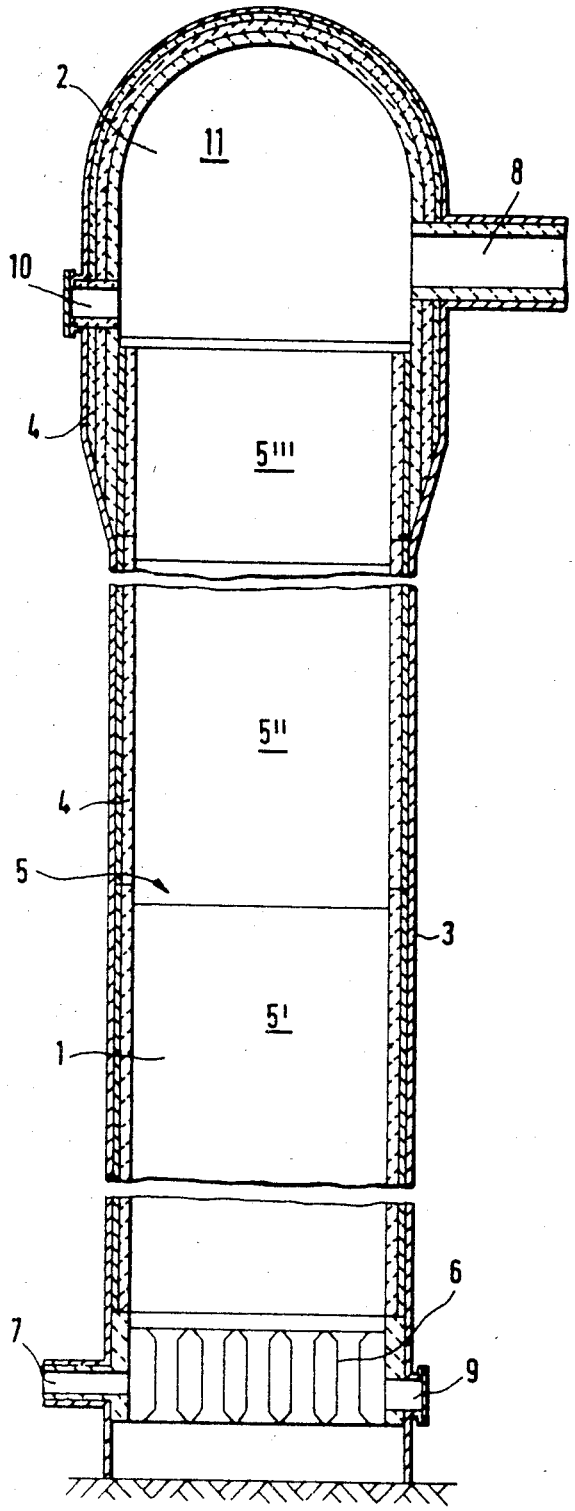
FIG. 1 is a cross sectional elevation view of a cowper having no combustion chamber having chequerwork therein in accordance with the present invention.

Referring first to FIG. 1, a cowper of the type having no combustion shaft or chamber which may be provided with the novel chequerwork in accordance with the present invention is generally shown. It will be appreciated that while the present invention is particularly well suited for a cowper of the type shown in FIG. 1, the present invention is equally well suited for a cowper of conventional construction.

Still referring to FIG. 1, a cowper of the type having no combustion shaft consists of a vertical chequerwork shaft or chamber 1 and a cupola 2, offset from the chequerwork chamber so as to permit expansion, both of which are enclosed by a gas-tight iron shell 3. Iron shell 3 is protected in a conventional manner by refractory masonry and insulating materials 4. Chamber 1 is equipped with a chequerwork or filling 5 of refractory bricks for storing or releasing heat. In the embodiment shown in FIG. 1, filling 5 consists of three different layers. The refractory chequerwork rests on a grid iron 6 supported by support columns. A connecting pipe 7 is provided at the lower end of the cowper (i.e., at the level of the grid iron 6), both for entering cold air to be heated and for waste or flue gases to be extracted during heating of the chequerwork. The cupola 2 which seals the top of the cowper is positioned on top of the chamber masonry 5 in a conventional manner so that the chamber 1, and the internal masonry, can expand into the masonry of the cupola. The arch of the cupola 2 is provided with a connecting pipe 8 which serves to extract heated air passed through the cowper. At least one manhole 9 and 10, respectively, is provided at the lower end of the cowper (i.e., at the level of the grid iron), and also in the cupola wall somewhat above the filling 5.

The cowper shown in FIG. 1 differs from those cowpers conventionally in operation at present in that the cupola arch thereof is designed as a combustion chamber wherein at least one, but preferably a plurality of burners terminate and are symmetrically arranged around the cupola periphery. The cowper of FIG. 1 is more fully described in co-pending Luxembourg patent application Ser. No. 85.029, corresponding to U.S. patent application Ser. No. 657,026, filed the same day as the present invention, assigned to the assignee hereof, all of the contents of which are incorporated herein by reference.

As mentioned above and as indicated in FIG. 1, the filler brick zone 5 of chequerwork chamber 1 is divided into three different zones 5', 5'', 5''', which are either designed with different chequerworks and/or are equipped with filler bricks of differing material compositions. It will be appreciated that the individual zones are of different heights; the bottom colder zone 5' being of substantially longer height than the very hot zone 5''' which is directly adjacent the cupola 2.

Figure 2A:
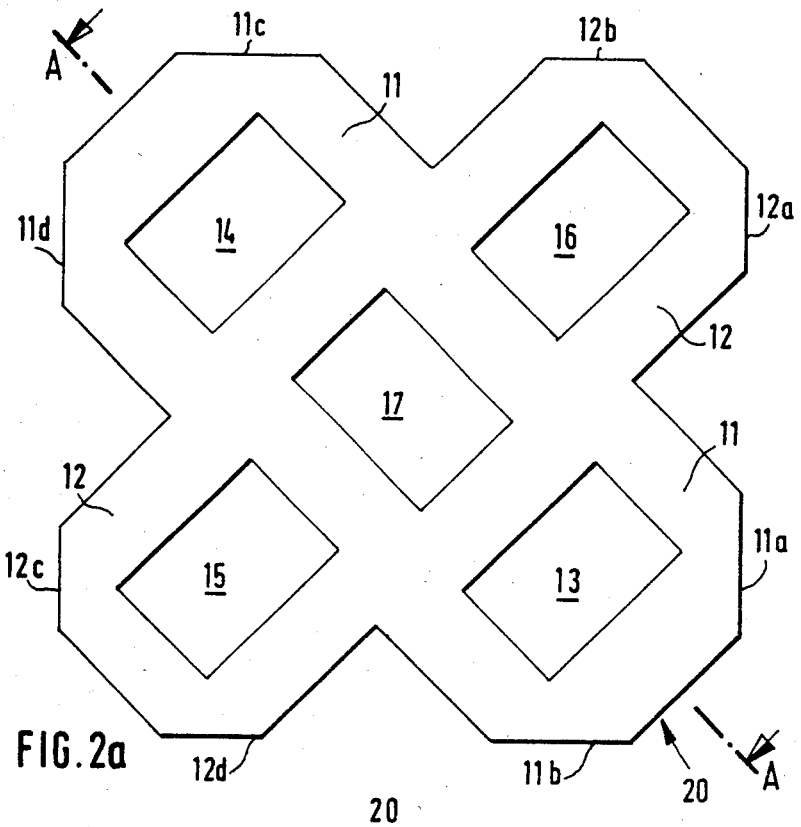
FIG. 2*a* is a plan view of a chequer brick in accordance with the present invention.
Figure 2B:
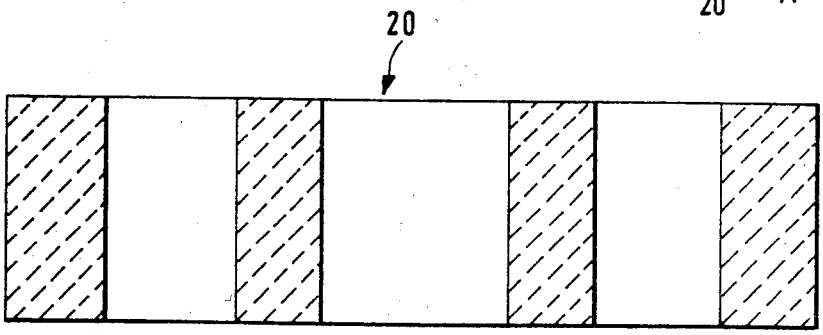
FIG. 2*b* is a cross sectional elevation view along the line A—A of FIG. 2*a;*

In the illustrated embodiment of FIG. 1, the different zones 5', 5'', 5''' are provided with filler or chequer bricks such as that shown in FIGS. 2*a* and 2*b*. As can be seen from FIG. 2*a*, filler bricks 20 essentially has a cruciform shape inscribed diagonally in a square, the two cross members 11 and 12 being provided with different widths, but having the same length. The cross members 11 and 12 have oblique cut-off sections of about a 45° angle at each of their respective outer corners 11*a*, 11*b*, 11*c*, 11*d* and 12*a*, 12*b*, 12*c* and 12*d*. Rectangular grooves or conduits 13, 14, 15, 16 and 17 of about the same size are provided in the members 11 and 12. It will be appreciated that conduits 13 and 14 are symmetrically arranged relative to the center of the brick in the arms of beam 11, and are placed with their longer sides at right angles transverse to the longitudinal axis of the beam, whereas conduits 15 and 16 are similarly symmetrically arranged relative to the center of the brick in the arms of the beam 12, but are oriented with their longer sides toward the longitudinal axis of the beam. Conduit 17 is centrally arranged relative to the center of the brick (i.e., at the junction between cross members 11 and 12), and in a manner such that its longer sides are mutually perpendicular to transverse sides of conduits 15 and 16 and its transverse sides are each opposite to longer sides of conduits 13 and 14. As shown in FIG. 2*b*, filler brick 20 has a uniform thickness (height) in its cross section.

One of the important features and advantages of the filler brick of FIG. 1 and in accordance with the present invention is that all inner and outer brick edges are rectilinear. As a consequence, filler brick 20 can be produced without major technological difficulties and thus can be manufactured at a low cost.

For reasons described in detail below, it may be necessary to provide some of the filler bricks described above with conduits of square cross-section instead of rectangular cross-section.

Figure 3:
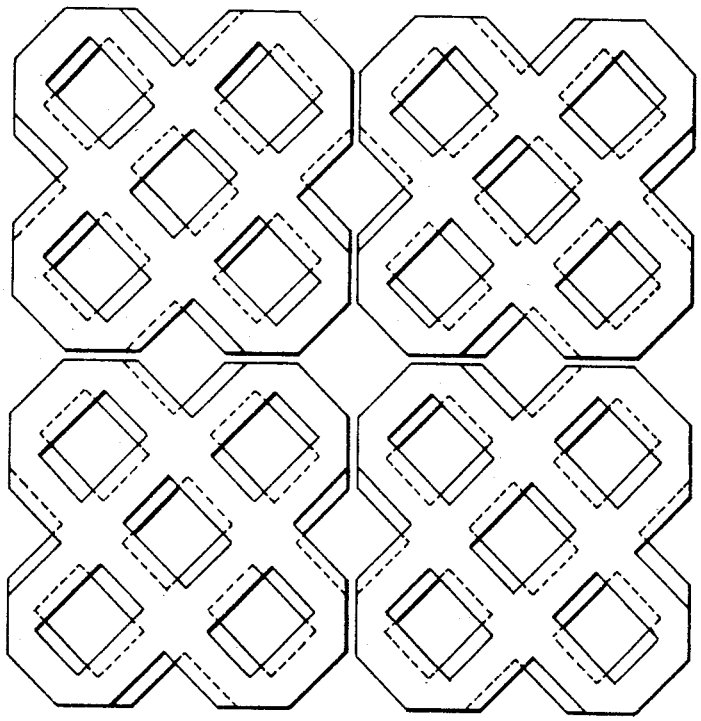
FIG. 3 is a plan view of a first method of stacking the chequer brick of FIG. 2*a;*
Figure 4:
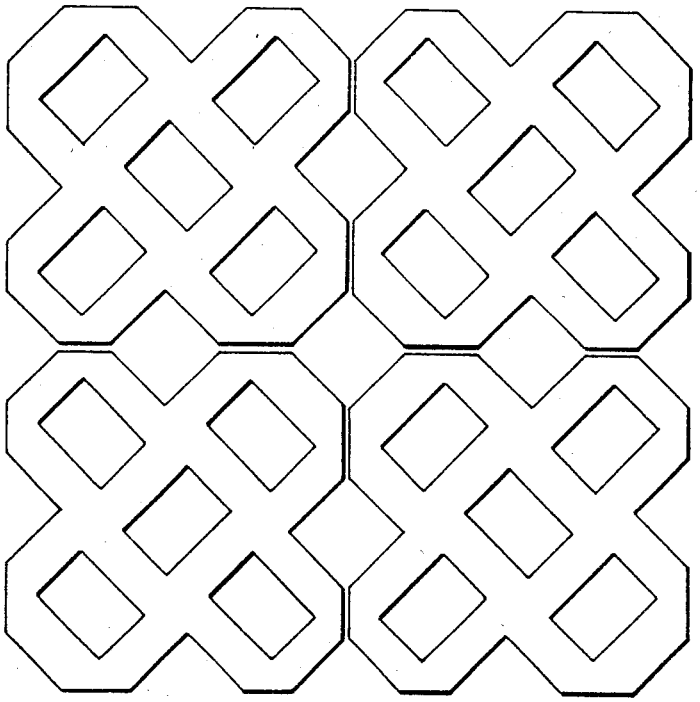
FIG. 4 is a plan view of a second method of stacking the chequer brick of FIG. 2*a;*
Figure 5:
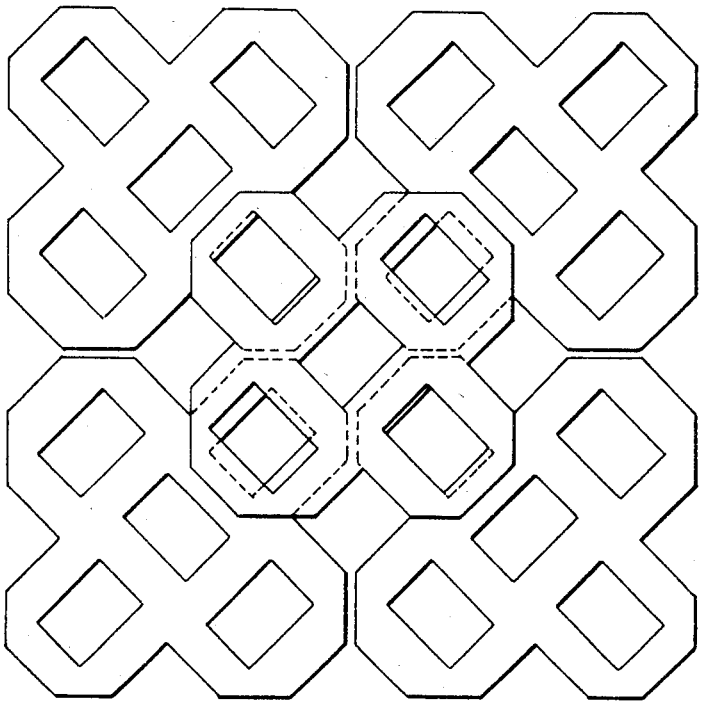
FIG. 5 is a plan view of a third method of stacking the chequer brick of FIG. 2*a;*

As will be discussed below, the novel filler brick of the present invention is basically formed from a square shape, said square shape reappearing in the stacking assembly of the bricks such as is shown in FIGS. 3, 4 and 5 wherein various methods of stacking the bricks in the individual filler brick zones is described.

Referring now to FIG. 3, a first method of stacking chequer-bricks of the present invention which is labelled the "herringbone" method of stacking is shown wherein the bricks of superimposed layers are alternately turned through 90° relative to adjacent layers.

In FIG. 4, a "uniform" method of stacking the chequer-bricks in all the superimposed layers is shown. As in FIG. 3, the bricks lying adjacent to one another in the same layer are reversed in position, although, unlike FIG. 3, two superimposed brick layers are not turned 90° relative to one another.

In FIG. 5, the bricks of two superimposed layers are both turned through 90° (as in FIG. 3) and also arranged with a "bond" by staggering or overlapping adjacent layers. This method of staggered stacking provides improved integration which results in better stability.

In accordance with the preferred embodiment of the present invention, the various methods of stacking shown in FIGS. 3 and 5 are used, in the filler brick zones 5' and 5'', respectively. This arrangement provides strong turbulence of the media (waste gas or cold blast) flowing through the two zones, thereby resulting in substantially increased heat exchange (in one or the other direction). Moreover, the medium flowing through the chequerwork has an available heat exchange surface which is increased by approximately 10% (over prior art chequerwork), while the thickness of the brick remains unchanged, (which also improves heat exchange).

In an effort to stabilize the pile of filler bricks, at least every fifth layer is preferably laid in the bonded or staggered stacking manner shown in FIG. 5. The differences in height brought about by production tolerances are likewise compensated by culling the bricks after every fifth layer.

The top filler brick zone 5''' is preferably designed with the method of stacking in accordance with FIG. 4, which has a low flow resistance. The correspondingly reduced convective heat transmission of the FIG. 4 stacking arrangement is compensated by the high radiation along this point in the chequerwork.

In a preferred embodiment, different construction materials have been selected for forming the individual filler brick zones, namely silica bricks in the high-temperature zone 5''', high-alumina bricks in the middle zone 5'' and chamotte bricks in the bottom zone 5'. However, all the bricks used herein have the same shape as that shown in FIG. 2, which as discussed makes them substantially easier to produce than prior art bricks.

Referring now to FIGS. 6*a* and 6*b*, a second embodiment of the chequer-brick in accordance with the present invention is shown. The chequer-brick of FIG. 6*a* differ in both shaping and method of stacking from the embodiment described above in connection with FIG. 2. It will be appreciated that the chequer-brick of FIG. 6 may be preferable over the brick of FIG. 2 in that it produces a uniform flow or exposure as well as increased stability to the chequerwork.

Figure 7:
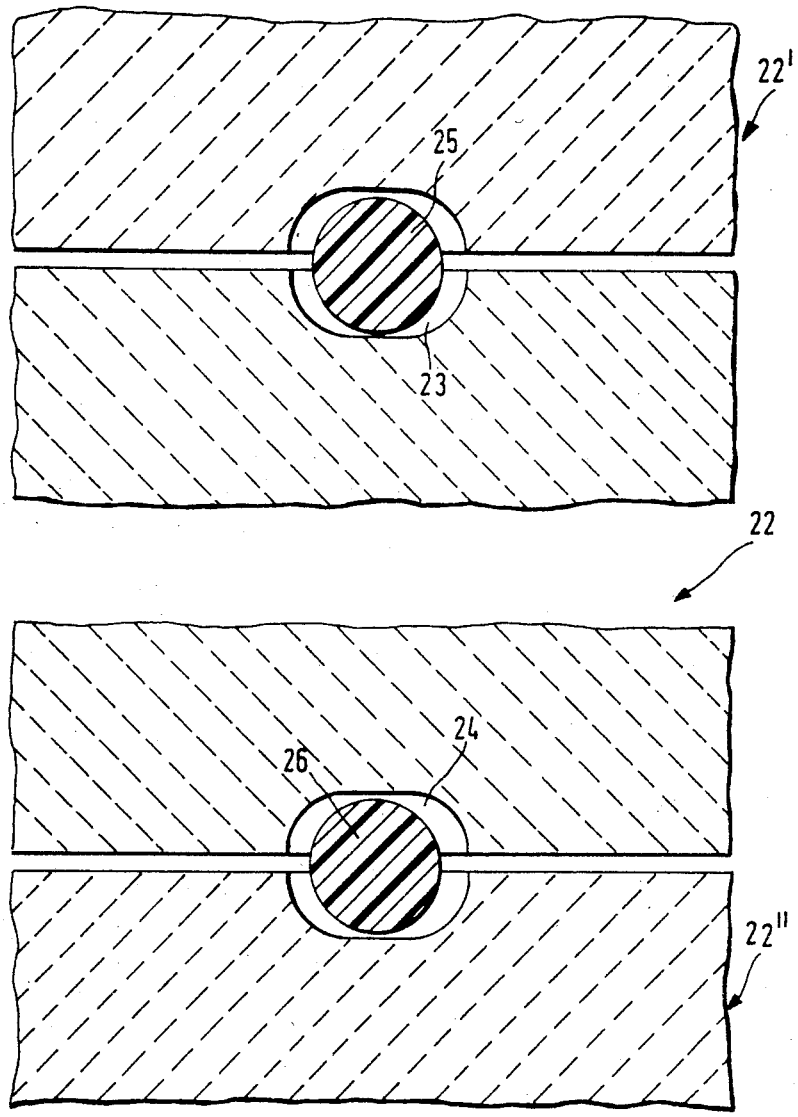
FIG. 7 is a cross sectional elevation view through a plurality of layers of the chequer brick of FIG. 6*a* in accordance with the present invention.

In FIG. 6*a*, it can be seen that the chequer-brick 22 essentially retains the basic shape of the brick 20 of FIG. 2, except that the shape is improved by providing the same wall thickness "a" in both cross-members, thereby providing a uniform configuration. Moreover, brick 22 is further provided with grooves or recesses 23, 24 (FIG. 6*b*) on its top and bottom surfaces. In a preferred embodiment, inserts, for example, balls, or mouldable plugs 25, 26 (FIG. 7), may be provided in recesses 23, 24 to fix the brick 22 relative to bricks 22' and 22'' which are respectively located in the adjacent layers (see also FIG. 8).

With regard to a method of stacking the bricks in FIG. 6, the uniform shaping of the chequer-brick 22 (same wall thickness "a" throughout) means that the only passageways now obtained in the chequerwork are those of rectangular cross-section, in contrast to those produced using the chequer-brick 20, which were of both rectangular and square cross-section. This is best seen from a comparison between FIG. 8 and FIG. 5.

Figure 8:
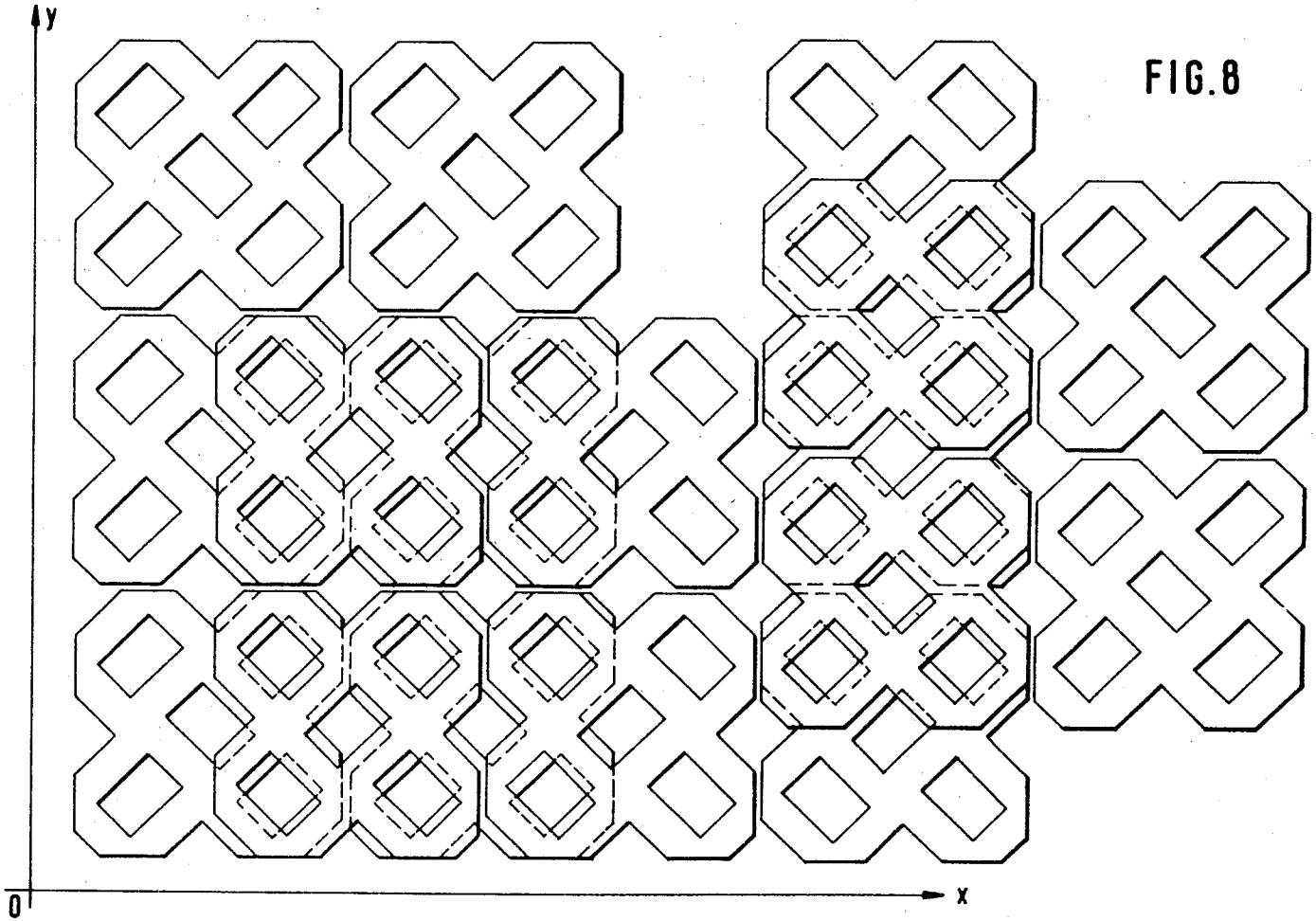
FIG. 8 is a plan view showing a method of stacking the chequerwork of FIG. 6*a* in accordance with the present invention.

Preferably, all chequer-brick layers, as can be seen from FIG. 8, are laid with the chequer-brick 22 bonded (i.e., staggering adjacent layers), but in every case with the upper brick encompassing only two of the lower bricks. The third layer of bond, which also overlays only two bricks, does however complete the circle, i.e., the third layer of bond theoretically clings to four bricks of the bottom layer.

It has been found that the modified shape or configuration of brick 22 as compared to brick 20 produces more uniform cross-section throughout the chequerwork, which in turn, ensures uniform convection and radiation and hence optimum transmission of heat throughout the chequerwork. The desired turbulence takes effect in all the passage conduits in each layer of bricks, that is to say, it now applies to the entire heating surface. As a result, improved efficiency of the chequerwork is achieved with the brick 22 of FIG. 6. As all the layers can now be bonded in the individual filler brick zones, improved stability of the chequerwork can be achieved. Also, due to the rigidity imparted by means of the prefabricated balls or mouldable plugs, mutual displacement of the bricks is avoided.

Figure 9A:
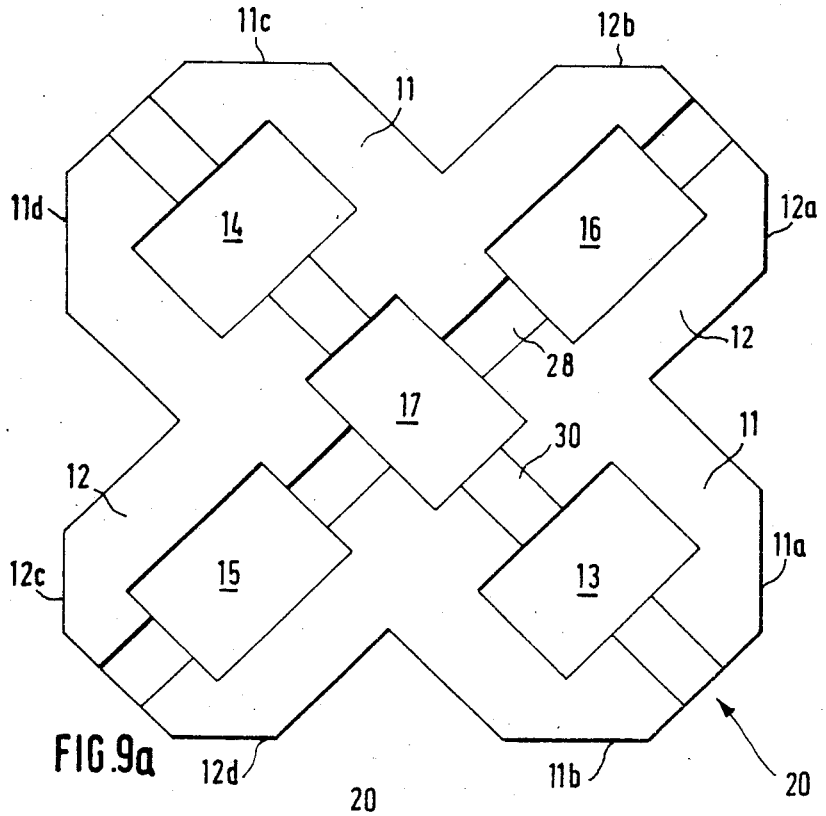
FIG. 9*a* is a plan view of still another embodiment of the chequer brick in accordance with the present invention.
Figure 9B:
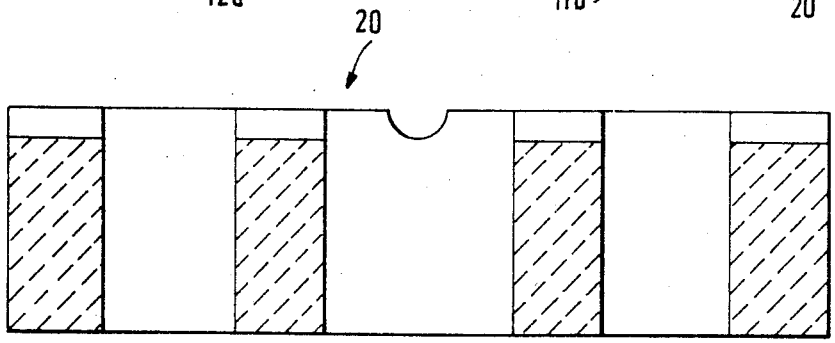
FIG. 9*b* is a cross sectional elevation view along the line A—A of FIG. 9*a;*

Still another embodiment of the chequer-brick of the present invention is shown in FIGS. 9*a* and 9*b* wherein each brick 20 is provided either on the top or on the bottom with two grooves 28 and 30, each groove 28,30 extending over the entire length of each cross-member 11, 12 and hence connecting the vertical conduits 13–17 with one another. The cross-section of the grooves 28, 30 is preferably semi-circular, having a depth of about 10 mm. The effect of these grooves is that combustion gas or cold blast can, in the case of convective heat exchange with the bricks, flow horizontally through the layers, as a result of which the heat exchange surface in the chequerwork is increased and the efficiency is correspondingly improved.

Figure 10A:
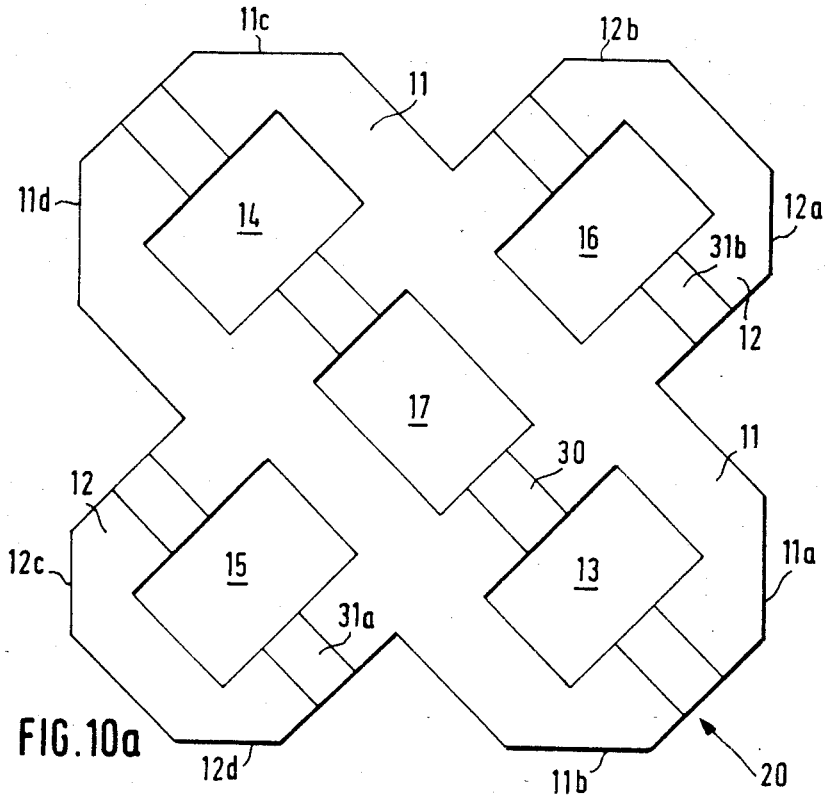
FIG. 10*a* is a plan view of yet another embodiment of the chequer brick in accordance with the present invention.
Figure 10B:
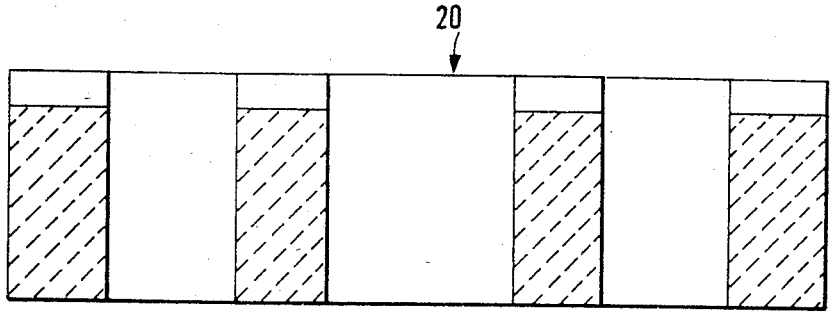
FIG. 10*b* is a cross sectional elevation view along the line A—A of FIG. 10*a.*

In FIGS. 10*a* and 10*b*, a modification of the embodiment of FIGS. 9*a* and 9*b* is shown, wherein three grooves 30, 31*a* and 31*b* are provided, one groove 30 extending in the longitudinal direction of one of the cross-members of the chequer-brick 20 and the other two grooves 31*a* and 31*b* extending parallel thereto, transverse to the other cross-member. All of grooves 28, 30, 31*a* and 31*b* can be provided either on the top or on the bottom of the chequer-brick 20; preferably all grooves being of equal depth.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. Chequer-brick for use in conjunction with the chequerwork of vertical cowpers wherein each of said chequer-bricks comprise:

brick means, said brick means having mutually parallel top and bottom surfaces, said brick means including two cross-members defining a cruciform shape;

said cross-members being of about equal length and having different widths; and a plurality of conduits in said cross-members connecting said top and bottom surfaces.

2. The chequer-brick of claim 1 wherein:

said cruciform shape is inscribed diagonally within a square.

3. The chequer-brick of claim 1 wherein said conduits have a rectangular cross-section.

4. The chequer-brick of claim 1 wherein said conduits are symmetrically positioned along each of said cross-members.

5. The chequer-brick of claim 3 wherein said conduits are symmetrically positioned along each of said cross-members.

6. The chequer-brick of claim 5 including:

two conduits symmetrically arranged along each of said two cross-members.

7. The chequer-brick of claim 6 wherein:

each of said rectangular conduits has a pair of longer sides and a pair of shorter sides; and wherein said longer sides of said four conduits are mutually parallel.

8. The chequer-brick of claim 1 including:

a central conduit located at about the junction between said two cross-members and connecting said top and bottom surfaces.

9. The chequer-brick of claim 7 including:

a central conduit located at about the junction between said two cross-members and connecting said top and bottom surfaces.

10. The chequer-brick of claim 9 wherein:

said central conduit is of rectangular cross-section having a pair of longer sides and a pair of shorter sides; and wherein said longer sides are perpendicular to the longer sides of said four conduits.

11. The chequer-brick of claim 1 wherein:

said cross-members each include two ends; and wherein said ends each have a pair of cut-offs.

12. The chequer-brick of claim 11 wherein:

said cut-offs are at an angle of about 45 degrees.

13. The chequer-brick of claim 12 wherein:

the lateral surfaces of said wider cross-member are longer than the adjoining lateral surfaces of said narrower cross-member wherein the distance between some of the sides of said conduits and the sides of said cross-members relative to the distance between other of the sides of said conduits and the sides of said cross-members are different.

14. The chequer-brick of claim 12 wherein:

the lateral surfaces of adjoining cross-members are of about equal length; and wherein the relative dimension between the sides of said conduits and the sides of said cross-members are about equal.

15. The chequer-brick of claim 1 further including:

at least one recess in at least one of said top or bottom surfaces of said brick means, said recess being adapted to receive insert means.

16. The chequer-brick of claim 1 further including:

at least one groove in at least one of said top or bottom surfaces.

17. The chequer-brick of claim 16 including:

two grooves on said top or bottom surfaces, said grooves extending over the longitudinal length of each of said cross-members.

18. The chequer-brick of claim 16 including:

three mutually parallel grooves on said top or bottom surfaces, one of said grooves extending over the longitudinal length of one of said cross-members and the other two of said grooves extending over the other of said cross-members in a direction transverse to said first groove.

19. The chequer-brick of claim 16 wherein:

said groove has a semi-circular cross-section.

20. Chequerwork for a vertical cowper having a vertical chamber with one or more superimposed chequer-brick zones, the chequer-brick zones including a plurality of chequer-bricks, each chequer-brick comprising:

brick means, said brick means having mutually parallel top and bottom surfaces, said brick means including two cross-members defining a cruciform shape;

said cross-members being of about equal length and having different widths; and a plurality of conduits in said cross-members connecting said top and bottom surfaces.

21. The chequerwork of claim 20 wherein:

said plurality of chequer-bricks are stacked in layers wherein said conduits form vertical passageways through said layers.

22. The chequerwork of claim 21 wherein each of said chequer-bricks include:

a central conduit located at about the junction between each of said two cross-members and connecting said top and bottom surfaces.

23. The chequerwork of claim 22 wherein:

said central conduits form vertical passageways through said layers.

24. The chequerwork of claim 21 wherein each of said chequer-brick cross-members include two ends; and wherein said ends each have a pair of cut-offs.

25. The chequerwork of claim 24 wherein:

the intersection between the cross-members and cross-member cut-off ends define vertical passageway through said layers.

26. The chequerwork of claim 21 wherein:

at least some of the individual chequer-bricks in each layer are superimposed directly above individual chequer-bricks of an adjoining layer.

27. The chequerwork of claim 26 wherein:

a first of two adjacent superimposed bricks is turned through 90 degrees relative to the second brick.

28. The chequerwork of claim 26 wherein:

adjacent bricks in the same layer are reversed in position relative to one another.

29. The chequerwork of claim 27 wherein:

adjacent bricks in the same layer are reversed in position relative to one another.

30. The chequerwork of claim 21 wherein:

at least one of the bricks of one of the layers are superimposed above the corner points of four adjacent bricks in an adjacent layer.

31. The chequerwork of claim 21 wherein:

at least some of the adjacent bricks in the same layer are reversed in position relative to one another.

32. The chequerwork of claim 21 wherein:

at least some of the adjacent bricks in the same layer are of the same orientation.

33. The chequerwork of claim 21 wherein:

at least one of the bricks of at least one of the layers are disposed above two adjacent bricks of an adjacent lower layer and below two adjacent bricks of an adjacent higher layer; and said adjacent bricks of said lower layer are stacked in a row which is perpendicular to the row wherein said adjacent bricks of said upper layer are stacked.

* * * * *